US009293087B2

(12) United States Patent
Lee et al.

(10) Patent No.: US 9,293,087 B2
(45) Date of Patent: Mar. 22, 2016

(54) PIXEL AND ORGANIC LIGHT EMITTING DISPLAY DEVICE USING THE SAME

(71) Applicant: SAMSUNG DISPLAY CO., LTD., Yongin, Gyeonggi-Do (KR)

(72) Inventors: Tak-Young Lee, Yongin (KR); Yong-Sung Park, Yongin (KR)

(73) Assignee: Samsung Display Co., Ltd, Yongin-si (KR)

( * ) Notice: Subject to any disclaimer, the term of this patent is extended or adjusted under 35 U.S.C. 154(b) by 0 days.

(21) Appl. No.: 14/709,310

(22) Filed: May 11, 2015

(65) Prior Publication Data

US 2016/0012780 A1 Jan. 14, 2016

(30) Foreign Application Priority Data

Jul. 14, 2014 (KR) ..... 10-2014-0088528

(51) Int. Cl.
*G09G 3/32* (2006.01)
*G09G 5/18* (2006.01)

(52) U.S. Cl.
CPC ..... *G09G 3/3291* (2013.01); *G09G 5/18* (2013.01); *G09G 2300/0426* (2013.01)

(58) Field of Classification Search
CPC .... G09G 3/3291; G09G 5/18; H05H 33/0896
USPC ..... 345/204, 212; 315/172, 291
See application file for complete search history.

(56) References Cited

U.S. PATENT DOCUMENTS

2010/0283955 A1 11/2010 Kim et al.
2011/0310077 A1 12/2011 Hwang et al.
2012/0019499 A1 1/2012 Hwang et al.
2013/0328753 A1 12/2013 Tsuge
2014/0139503 A1* 5/2014 Han ..... G09G 3/3291 345/212
2014/0198085 A1 7/2014 Park et al.
2015/0061538 A1* 3/2015 Miyazawa ..... G09G 3/00 315/291
2015/0154906 A1* 6/2015 Chung ..... G09G 3/3233 345/212
2015/0187266 A1* 7/2015 Qian ..... G09G 3/3233 345/77
2015/0187273 A1* 7/2015 Chang ..... G09G 3/3258 345/690
2015/0262528 A1* 9/2015 Takahara ..... G09G 3/3225 345/212
2015/0302798 A1* 10/2015 Tan ..... G09G 3/3233 345/698
2015/0302799 A1* 10/2015 Feng ..... G09G 3/3233 345/76

FOREIGN PATENT DOCUMENTS

CN 103943063 A 7/2014
KR 10-2010-0121893 A 11/2010
KR 10-2011-0138554 A 12/2011
KR 10-2012-0009672 A 2/2012
KR 10-2013-0132991 A 12/2013

* cited by examiner

*Primary Examiner* — Don Le
(74) *Attorney, Agent, or Firm* — Lewis Roca Rothgerber Christie LLP

(57) ABSTRACT

There is provided a pixel having an improved display quality. The pixel includes an OLED, a first transistor including a first electrode coupled to a data line and a second electrode coupled to an anode electrode of the OLED, and configured to control a current supplied to the OLED based on a voltage applied to a first node; a second transistor coupled between the data line and a second node; a third transistor coupled between the second node and a first power line for supplying reference power; and a first capacitor coupled between the first node and the second node.

20 Claims, 9 Drawing Sheets

PIXEL AND ORGANIC LIGHT EMITTING DISPLAY DEVICE USING THE SAME

CROSS-REFERENCE TO RELATED APPLICATION

This application claims priority to and the benefit of Korean Patent Application No. 10-2014-0088528, filed on Jul. 14, 2014, in the Korean Intellectual Property Office, the contents of which are incorporated herein by reference in their entirety.

BACKGROUND

1. Field

The embodiments of the present invention relate to a pixel and an organic light emitting display device using the pixel.

2. Description of the Related Art

With recent developments in information technology, the importance of a display device that is a connection medium between a user and information has increased. Thus, there is a growing tendency to use flat panel display (FPD) devices, such as liquid crystal display devices, organic light emitting display devices, or plasma display panels.

Among the FPD devices, the organic light emitting display device displays images using organic light emitting diodes (OLEDs) that generate light through the recombination of electrons and holes. The organic light emitting display device has a high response speed and can be driven with low power consumption.

SUMMARY

Embodiments of the present invention include a pixel and an organic light emitting display device using the pixel, which are configured to minimize or reduce the number of signal lines formed on a panel, thus increasing driving reliability and improving display quality.

According to an embodiment of the present invention, there is provided a pixel including an organic light emitting diode (OLED); a first transistor having a first electrode coupled a data line and a second electrode coupled an anode electrode of the OLED, and configured to control a current supplied to the OLED based on a voltage applied to a first node; a second transistor coupled between the data line and a second node; a third transistor coupled between the second node and a first power line for supplying reference power; and a first capacitor coupled between the first node and the second node.

The pixel may further include a fourth transistor coupled between the second electrode of the first transistor and the first node, a fifth transistor coupled between the second electrode of the first transistor and the anode electrode of the OLED, and a sixth transistor coupled between the first node and a second power line for supplying initial power.

The reference power may be set to a specific voltage that is within a voltage range of a data signal provided to the data line, and the initial power may be set to a voltage that is lower than a voltage of the data signal.

Turn-on periods of the second transistor, the third transistor, and the sixth transistor may not overlap each other.

The fifth transistor may be configured to be turned on and turned off simultaneously with the second transistor.

A turn-on period of the fourth transistor may overlap the turn on period of the third transistor.

The pixel may further include a seventh transistor coupled between the anode electrode of the OLED and the second power line, the seventh transistor being configured to be turned on and off simultaneously with the sixth transistor.

The pixel may further include a second capacitor coupled between the first node and the second power line.

The first power line and the second power line may be set as one power line, the reference power may be supplied to the power line during a preset period of one frame, and the initial power may be supplied to the power line during a remaining period thereof.

The voltage of a data signal may be supplied to the data line during a period when the third transistor is configured to be turned on, and a voltage of a first power source that is higher than the voltage of the data signal may be supplied to the data line during a remaining period.

According to another embodiment of the present invention, there is provided an organic light emitting display device including pixels positioned in regions defined by scan lines, data lines, a light-emission control line, a first control line, and a first power line; a scan driver configured to provide a light-emission control signal to the light-emission control line during first and second periods of one frame period and to sequentially provide scan signals to the scan lines during the second period; a data driver configured to provide data signals to the data lines during the second period, and to supply a voltage of a first power source that is set to be higher than a voltage of the data signal to the data lines during a third period subsequent to the first and second periods; and a control driver configured to provide a first control signal to the first control line during the first period.

The data driver may include a signal generator configured to generate the data signal; buffers formed on respective channels of the signal generator; and selectors coupled, respectively, to the data lines, and coupling the data lines to the first power source or the buffers. The selectors may couple the data lines to the first power source during the first period and the third period, and may couple the data lines to the buffers during the second period.

Among the pixels, a pixel positioned at an $i^{th}$ (i is a natural number) horizontal line and a $j^{th}$ (j is a natural number) vertical line may include an OLED; a first transistor including a first electrode coupled to a $i^{th}$ data line and a second electrode coupled to an anode electrode of the OLED, the first transistor being configured to control a current supplied to the OLED based on a voltage applied to a first node; a second transistor coupled between the $j^{th}$ data line and a second node, the second transistor being configured to be turned off when the light-emission control signal is provided and being configured to be turned on in other cases; a third transistor coupled between the second node and the first power line; and a fourth transistor coupled between the second electrode of the first transistor and the first node, and configured to be turned on when a scan signal is provided to an $i^{th}$ scan line.

The organic light emitting display device may further include a second control line coupled to the pixels, and receiving a second control signal from the control driver during the second period. The third transistor may be configured to be turned on when the second control signal is provided.

The third transistor may be configured to be turned on when the scan signal is provided to the $i^{th}$ scan line.

The first power line may be supplied with a voltage of a reference power source that is set to a voltage which is within a voltage range of the data signal.

The organic light emitting display device may further include a second power line coupled to the pixels and configured to supply a voltage of an initial power source that is set to a voltage that is lower than the voltage of the data signal.

Among the pixels, the pixel positioned at the $i^{th}$ horizontal line and the $j^{th}$ vertical line may include a fifth transistor coupled between the second electrode of the first transistor and the anode electrode of the OLED, the fifth transistor being configured to be turned off when the light-emission control signal is provided and being configured to be turned on in other cases; a sixth transistor coupled between the second power line and the first node, and configured to be turned on when the first control signal is provided; and a seventh transistor coupled between the anode electrode of the OLED and the second power line, and configured to be turned on when the first control signal is provided.

The organic light emitting display device may further include a switch configured to supply the voltage of an initial power source, which is set to be lower than the voltage of the data signal, to the first power line during the first period and the third period, and to supply the voltage of a reference power source, which is set to a voltage within a range of the data signal, to the first power line during the second period.

Among the pixels, the pixel positioned at the $i^{th}$ horizontal line and the $j^{th}$ vertical line may include a fifth transistor coupled between the second electrode of the first transistor and the anode electrode of the OLED, the fifth transistor being configured to be turned off when the light-emission control signal is provided and being configured to be turned on in other cases; a sixth transistor coupled between the first power line and the first node, and configured to be turned on when the first control signal is provided; and a seventh transistor coupled between the anode electrode of the OLED and the first power line, and configured to be turned on when the first control signal is provided.

BRIEF DESCRIPTION OF THE DRAWINGS

Example embodiments of the present invention will be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

The use of "may" when describing embodiments of the present invention refers to "one or more embodiments of the present invention." It will be understood that when an element or layer is referred to as being "on", "connected to", or "coupled to" another element or layer, it can be directly on, connected to, or coupled to the other element or layer, or one or more intervening elements or layers may be present. In contrast, when an element or layer is referred to as being "directly on," "directly connected to", or "directly coupled to" another element or layer, there are no intervening elements or layers present.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section, without departing from the spirit and scope of the inventive concept.

The terminology used herein is for the purpose of describing particular embodiments only and is not intended to be limiting of the inventive concept. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

As used herein, the term "substantially," "about," and similar terms are used as terms of approximation and not as terms of degree, and are intended to account for the inherent deviations in measured or calculated values that would be recognized by those of ordinary skill in the art.

Hereinafter, example embodiments of the present invention will be described in detail with reference to FIGS. 1 to 10.

Figure 1:
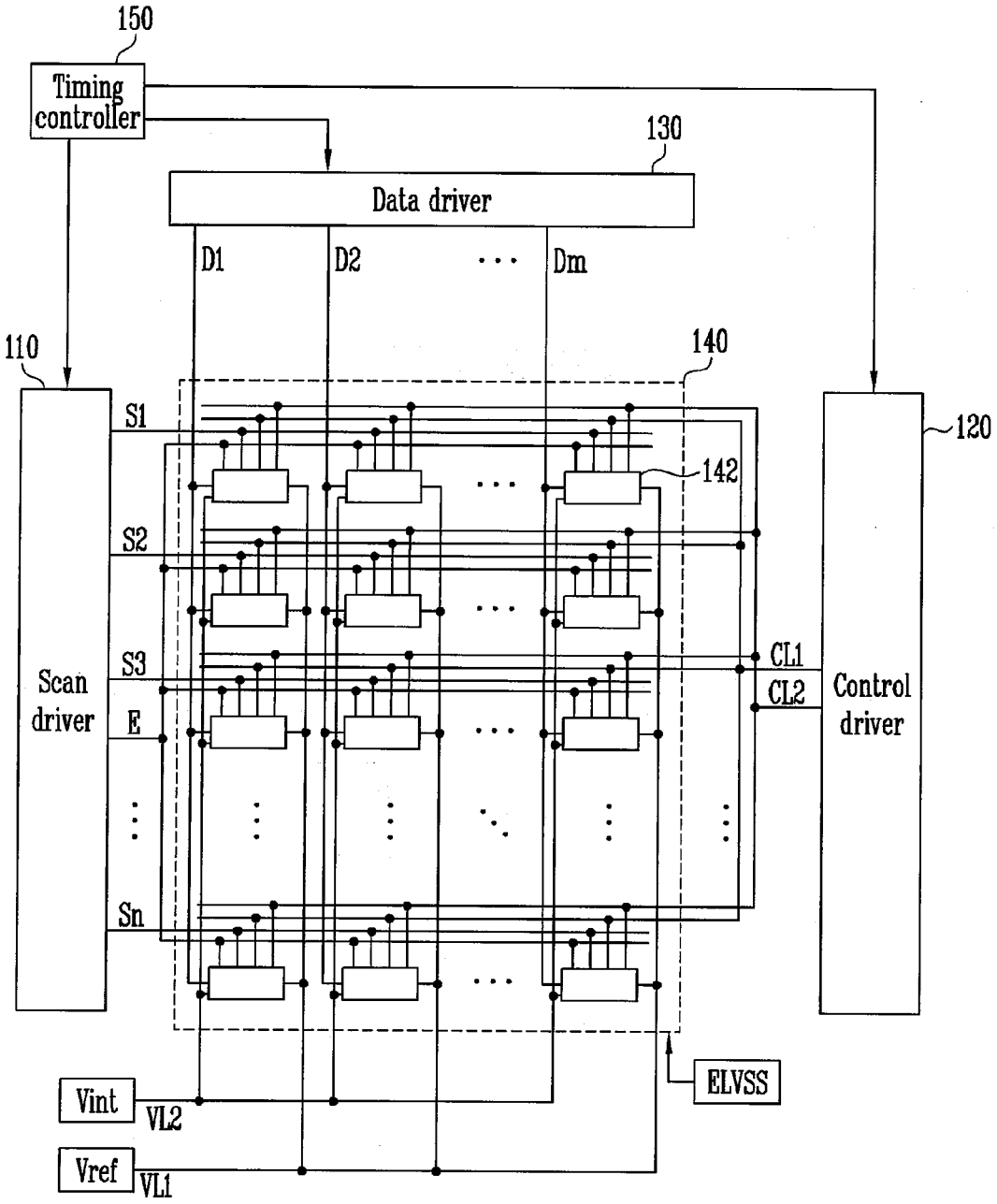
FIG. 1 is a view showing an organic light emitting display device according to a first embodiment of the present invention.

FIG. 1 is a view showing an organic light emitting display device according to a first embodiment of the present invention.

Referring to FIG. 1, the organic light emitting display device according to the first embodiment of the present invention includes a display unit 140 having pixels 142 that are positioned in regions defined by scan lines S1 to Sn, data lines D1 to Dm, a light-emission control line E, a first control line CL1, a second control line CL2, a first power line VL1 and a second power line VL2, a scan driver 110 configured to drive the scan lines S1 to Sn and the light-emission control line E, a control driver 120 configured to drive the first and second control lines CL1 and CL2, a data driver 130 configured to drive the data lines D1 to Dm, and a timing controller 150 configured to control the scan driver 110, the control driver 120 and the data driver 130.

Figure 4:
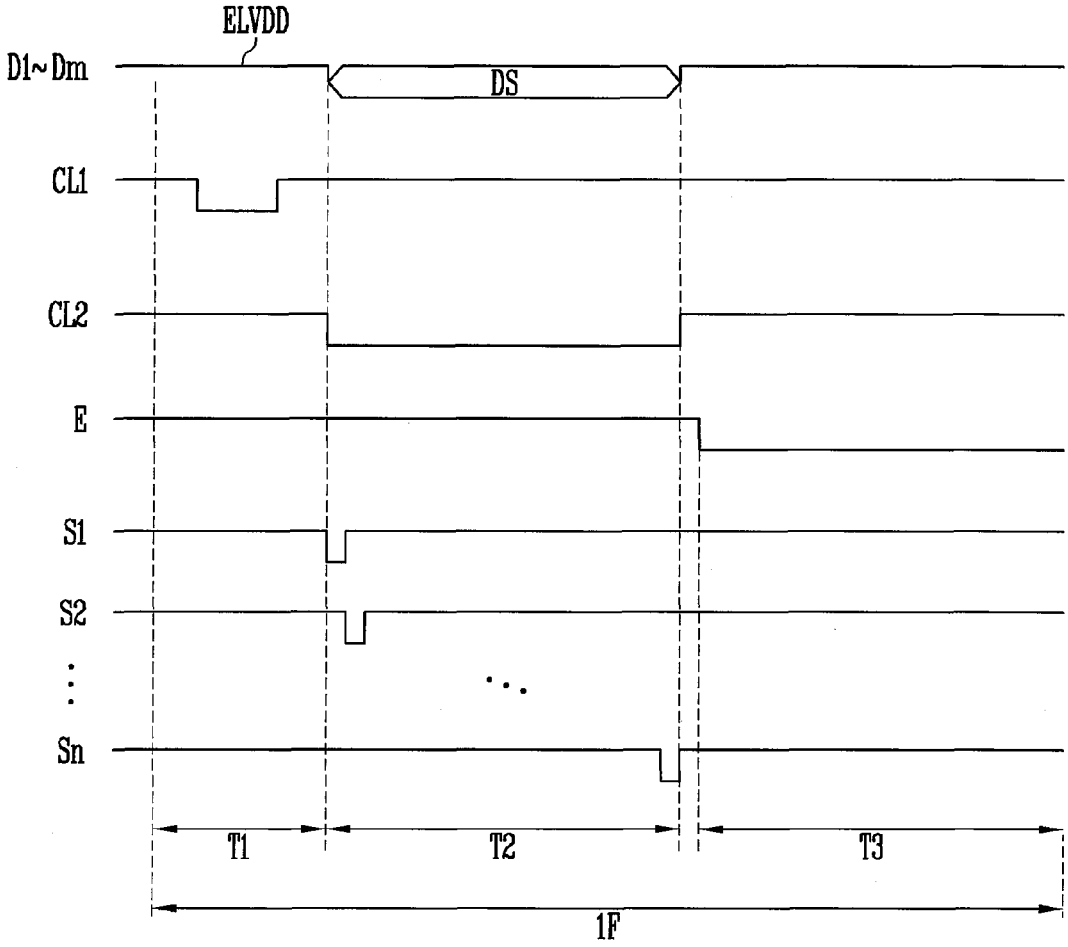
FIG. 4 is a waveform diagram showing a driving method according to a first embodiment of the present invention.

The scan driver 110 is configured to provide scan signals to the scan lines S1 to Sn. For example, as shown in FIG. 4, the scan driver 110 sequentially provides the scan signals to the scan lines S1 to Sn during a second period T2 of one frame 1 F.

Further, the scan driver 110 provides a light-emission control signal to the light-emission control line E that is connected in common to the pixels 142. For example, the scan driver 110 may provide the light-emission control signal to the light-emission control line E during the first and second periods T1 and T2 of one frame 1 F. The scan signal provided from the scan driver 110 is set to a voltage (e.g., a low voltage) at which a transistor included in the pixels 142 is turned on, and the light-emission control signal is set to a voltage (e.g., a high voltage) at which the transistor included in the pixels 142 is turned off.

The control driver 120 provides a first control signal to the first control signal CL1 that is connected in common to the pixels 142, and provides a second control signal to the second control line CL2 that is connected in common to the pixels 142. By way of example, the control driver 120 provides the first control signal during the first period T1 of one frame 1 F, and provides the second control signal during the second period T2. In this regard, the first control signal and the second control signal are set to the voltage (e.g., the low voltage) at which the transistors may be turned on.

The data driver 130 provides the voltage of the first power source ELVDD and the data signal to the data lines D1 to Dm. For example, the data driver 130 supplies the voltage of the first power source ELVDD to the data lines D1 to Dm during the first and third periods T1 and T3 of one frame 1 F, and provides the data signal during the second period T2. The first power source ELVDD is set to a voltage at which the pixels 142 may emit light, for instance, a voltage higher than that of the data signal.

The first power line VL1 is connected in common to the pixels 142, and supplies the voltage of a reference power source Vref to the pixels 142. The reference power source Vref is set to a specific voltage that is within a voltage range of the data signal.

The second power line VL2 is connected in common to the pixels 142, and supplies the voltage of an initial power source Vint to the pixels 142. The initial power source Vint is set to a voltage at which the OLED may be turned off. This feature of embodiments of the present invention will be described below in detail along with the structure of the pixel 142.

The timing controller 150 is configured to control the scan driver 110, the control driver 120, and the data driver 130, in response to sync signals provided from the outside.

The display unit 140 is provided with the pixels 142 that are located at regions defined by the scan lines S1 to Sn, the data lines D1 to Dm, the light-emission control line E, the first control line CL1, the second control line CL2, the first power line VL1 and the second power line VL2. The pixels 142 are set in a non-luminous state during the first and second periods T1 and T2 of one frame 1 F, and are set in a luminous state during the third period T3. For example, the pixels 142 charge a voltage corresponding to the data signal during the first and second periods T1 and T2, and emit light while controlling a current that flows from the first power source ELVDD through the OLED to the second power source ELVSS, depending on the voltage of the data signal during the third period T3.

Although FIG. 1 illustrates that the light-emission control line E is connected to the scan driver 110 and the control lines CL1 and CL2 are connected to the control driver 120 for the convenience of description, the present invention is not limited thereto. For example, the control lines CL1 and CL2 may be connected to the scan driver 110 and provided with the first and second control signals, respectively.

Figure 2:
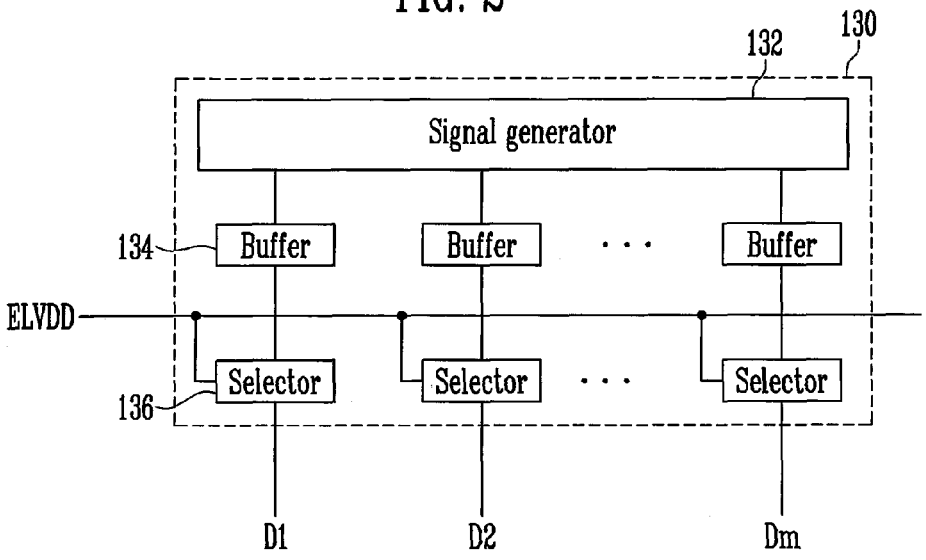
FIG. 2 is a schematic view showing a data driver according to an embodiment of the present invention.

FIG. 2 is a schematic view showing a data driver according to an embodiment of the present invention.

Referring to FIG. 2, the data driver 130 according to the embodiment of the present invention includes a signal generator 132 for generating a data signal, buffers 134 formed on respective channels, and selectors 136 connected to the buffers 134, respectively.

The signal generator 132 generates the data signal, and provides the generated data signal to the buffers 134 located at the respective channels. Each of the buffers 134 provides the data signal to the corresponding selector 136.

Each of the selectors 136 is connected to a corresponding one of the data lines D1 to Dm. These selectors 136 selectively connect the data lines D1 to Dm to the buffers 134 or the first power source ELVDD.

By way of example, the selectors 136 connect the data lines D1 to Dm to the buffers 134, respectively, during the second period T2 of one frame 1 F. Then, during the second period T2 of one frame 1 F, the data signal is provided from the signal generator 132 to the data lines D1 to Dm. Further, the selectors 136 connect the data lines D1 to Dm to the first power source ELVDD during the first and third periods T1 and T3 of one frame 1 F. Thereby, during the first and third periods T1 and T3 of one frame 1 F, the voltage of the first power source ELVDD is supplied to the data lines D1 to Dm.

According to embodiments of the present invention, the data driver 130 may be variously formed to provide the data signal and the voltage of the first power source ELVDD to the data lines D1 to Dm. Further, the selectors 136 are configured to selectively connect the data lines D1 to Dm to the buffers 134 and the first power source ELVDD. The selectors 136 may be formed outside the data driver 130.

Figure 3:
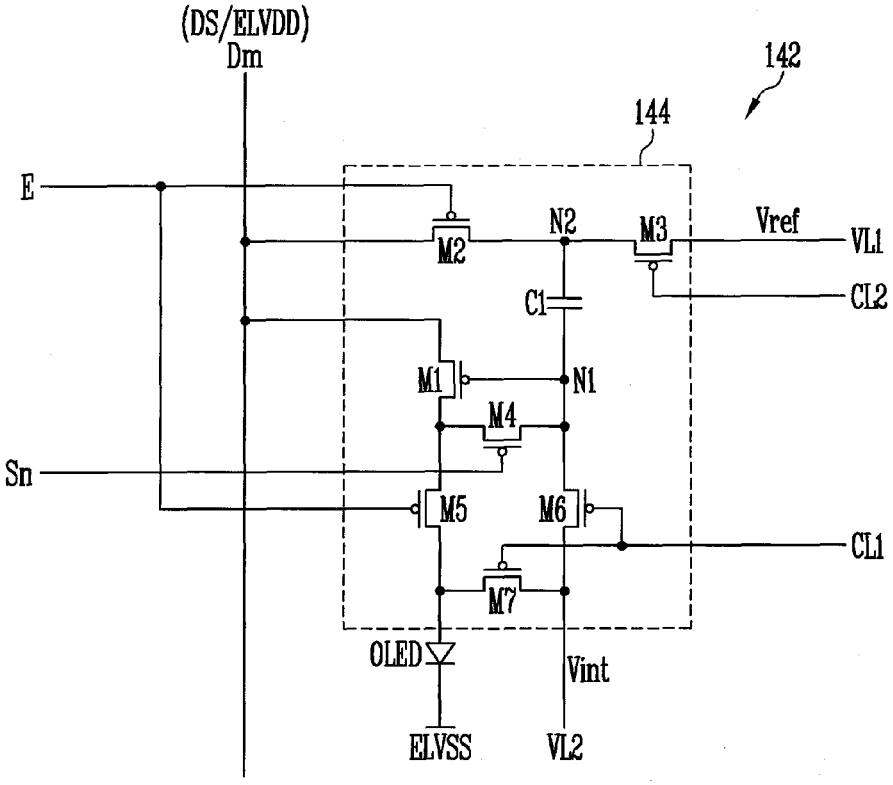
FIG. 3 is a view showing a pixel according to a first embodiment of the present invention.

FIG. 3 is a view showing a pixel according to a first embodiment of the present invention. FIG. 3 shows the pixel that is connected to an mth data line Dm and an nth scan line Sn for the convenience of description.

Referring to FIG. 3, the pixel 142 according to the first embodiment of the present invention includes an OLED, and a pixel circuit 144 configured to control a current supplied to the OLED.

An anode electrode of the OLED is connected to the pixel circuit 144, while a cathode electrode thereof is connected to a second power source ELVSS. The OLED generates a luminance (e.g., a predetermined luminance) of light in proportion to the current supplied from the pixel circuit 144. In order to allow the current to flow from the OLED, the voltage of the second power source ELVSS is set to be lower than that of the first power source ELVDD.

The pixel circuit 144 is configured to control a current flowing to the OLED, in response to the data signal DS. To this end, the pixel circuit 144 is provided with first to seventh transistors M1 to M7.

A first electrode of the first transistor M1 is connected to the data line Dm, while a second electrode thereof is connected via the fifth transistor M5 to the anode electrode of the OLED. Further, a gate electrode of the first transistor M1 is connected to a first node N1. The first transistor M1 is configured to control a current that flows from the first power source ELVDD (provided from the data line Dm) through the OLED to the second power source ELVSS, depending on a voltage applied to the first node N1.

The second transistor M2 is connected between the data line Dm and a second node N2. Further, the gate electrode of the second transistor M2 is connected to the light-emission control line E. The second transistor M2 is turned off when the light-emission control signal is provided to the light-emission control line E, and is turned on in other cases.

The third transistor M3 is connected between the second node N2 and the first power line VL1. Further, the gate electrode of the third transistor M3 is connected to the second control line CL2. The third transistor M3 is turned on when the second control signal is provided to the second control line CL2, thus electrically coupling (e.g., electrically connecting) the second node N2 with the first power line VL1.

The fourth transistor M4 is connected between the second electrode of the first transistor M1 and the first node N1. Further, the gate electrode of the fourth transistor M4 is connected to the scan line Sn. The fourth transistor M4 is turned on when the scan signal is provided to the scan line Sn, thus electrically coupling (e.g., electrically connecting) the second electrode of the first transistor M1 with the first node N1. Thus, when the fourth transistor M4 is turned on, the first transistor M1 is connected in a diode form.

The fifth transistor M5 is connected between the second electrode of the first transistor M1 and the anode electrode of the OLED. Further, the gate electrode of the fifth transistor M5 is connected to the light-emission control line E. The fifth transistor M5 is turned off when the light-emission control signal is provided to the light-emission control line E, and is turned on in other cases.

The sixth transistor M6 is connected between the first node N1 and the second power line VL2. Further, the gate electrode of the sixth transistor M6 is connected to the first control line CL1. The sixth transistor M6 is turned on when the first control signal is provided to the first control line CL1, thus electrically coupling (e.g., electrically connecting) the first node N1 with the second power line VL2.

The seventh transistor M7 is connected between the anode electrode of the OLED and the second power line VL2. Further, the gate electrode of the seventh transistor M7 is connected to the first control line CL1. The seventh transistor M7 is turned on when the first control signal is provided to the first control line CL1, thus electrically coupling (e.g., electrically connecting) the anode electrode of the OLED with the second power line VL2.

A first capacitor C1 is connected between the first node N1 and the second node N2. The first capacitor C1 stores the data signal DS and the voltage corresponding to a threshold voltage of the first transistor M1.

FIG. 4 is a waveform diagram showing a driving method according to a first embodiment of the present invention.

Referring to FIG. 4, one frame period, according to the first embodiment of the present invention, is divided into first to third periods T1 to T3.

In the first period T1, the first control signal is provided to the first control line CL1, and the light-emission control signal is provided to the light-emission control line E. When the light-emission control signal is provided to the light-emission control line E, the second transistor M2 and the fifth transistor M5 are turned off.

When the second transistor M2 is turned off, the data lines D1 to Dm are electrically interrupted from the second node N2 of each of the pixels 142. Thereby, the voltage of the first power source ELVDD is not supplied from the data lines D1 to Dm to the second node N2. When the fifth transistor M5 is turned off, the first transistor M1 of each of the pixels 142 is electrically interrupted from the anode electrode of the OLED. Thus, during the first and second periods T1 and T2 when the light-emission control signal is provided to the light-emission control line E, the pixels 142 are set in the non-luminous state.

When the first control signal is provided to the first control line CL1, the sixth and seventh transistors M6 and M7 of each pixel 142 are turned on. When the sixth transistor M6 is turned on, the second power line VL2 is electrically coupled (e.g., electrically connected) to the first node N1, so that the voltage of the initial power source Vint is supplied to the first node N1. That is, during the first period T1, the first node N1 is initialized to the voltage of the initial power source Vint that is lower than that of the data signal DS. Since the voltage of the first power source ELVDD is supplied to the first electrode of the first transistor M1, the first transistor M1 is initialized to an on bias state. In this case, the first transistor M1 of each pixel 142 is uniformly initialized regardless of the data signal DS of a previous frame.

When the seventh transistor M7 is turned on, the second power line VL2 is electrically coupled (e.g., electrically connected) to the anode electrode of the OLED, and thereby, the voltage of the initial power source Vint is supplied to the anode electrode of the OLED. When the voltage of the initial power source Vint is supplied to the anode electrode of the OLED, a parasitic capacitor (not shown) of the OLED is discharged, thus improving the ability of the pixels to express (or display) black. In other words, when the parasitic capacitor of the OLED is discharged, the OLED does not emit light by an unnecessary leakage current supplied from the pixel circuit 144, therefore the ability to express (or display) black is improved. In addition, since the voltage value of the initial power source Vint is set to prevent or substantially prevent the OLED from emitting unnecessary light, the unnecessary light is not generated from the pixels 142 during the first period T1.

In the second period T2, the light-emission control signal is provided to the light-emission control line E is maintained, and the second control signal is provided to the second control line CL2. Further, during the second period T2, the scan signal is sequentially provided to the scan lines S1 to Sn, and simultaneously (e.g., concurrently or substantially simultaneously) the data signal DS is provided to the data lines D1 to Dm in synchronization with the scan signal.

When the second control signal is provided to the second control line CL2, the third transistor M3 of each of the pixels 142 is turned on. When the third transistor M3 is turned on, the first power line VL1 is electrically coupled (e.g., electrically connected) to the second node N2. When, the first power line VL1 is electrically coupled (e.g., electrically connected) to the second node N2, the second node N2 of each of the pixels 142 receives the voltage of the reference power source Vref and the capacitor C1 is charged with and maintains the voltage of the reference power source Vref at the second node N2.

When the scan signal is sequentially provided to the scan lines S1 to Sn, the pixels 142 are selected on the basis of a horizontal line (e.g., row-by-row). For example, when the scan signal is provided to the first scan line S1, the fourth transistor M4 of each of the pixels 142 located at a first horizontal line is turned on. When the fourth transistor M4 is turned on, the first transistor M1 is connected in a diode form. When the first node N1 of each of the pixels 142 is set to the voltage of the initial power source Vint, the data signal DS provided to any one of the data lines D1 to Dm passes through the first transistor M1 connected in the diode form and then is provided to the first node N1. The first node N1 is set to a voltage obtained by subtracting the absolute value of the threshold voltage of the first transistor M1 from the voltage of the data signal DS. Then, the first capacitor C1 stores the voltage corresponding to a difference between the first node N1 and the second node N2. In practice, during the second period T2, the above-mentioned process is performed, and the voltage of a desired data signal DS is stored in the first capacitor C1 of each of the pixels 142.

In the third period T3, the provision or application of the light-emission control signal to the light-emission control line E is stopped, and the voltage of the first power source ELVDD is supplied to the data lines D1 to Dm. When the provision or application of the light-emission control signal to the light-emission control line E is stopped, the second transistor M2 and the fifth transistor M5 are turned on.

When the second transistor M2 is turned on, a corresponding one of the data lines D1 to Dm is electrically coupled (e.g., electrically connected) to the second node N2 of each of the pixels 142. Hence, the voltage of the second node N2 is increased from the voltage of the reference power source Vref to the voltage of the first power source ELVDD. Since the first node N1 is set to a floating state, the voltage of the first node N1 is increased in proportion to an increment in voltage of the second node N2. As such, the voltage Vgs of the first transistor M1 is kept constant, regardless of the IR drop of the first power source ELVDD, thus compensating for the IR drop of the first power source ELVDD.

When the fifth transistor M5 is turned on, the first transistor M1 is electrically coupled (e.g., electrically connected) to the anode electrode of the OLED. At this time, the first transistor M1 controls a current flowing from the first power source ELVDD of any one of the data lines D1 to Dm to the OLED depending on the voltage of the first node N1. The OLED generates a luminance (e.g., a predetermined luminance) of light depending on the current supplied from the first transistor M1.

In practice, the current supplied from the first transistor M1 to the OLED may be expressed as shown in Equation 1.

Equation 1

$$\begin{aligned} I &= \frac{1}{2}\mu C_{ox}\frac{W}{L}(ELVDD - (Vg + (ELVDD - Vref)) - |Vth|)^2 \\ &= \frac{1}{2}\mu C_{ox}\frac{W}{L}(ELVDD = (Vdata = |Vth| + (ELVDD = Vref)) = |Vth|)^2 \\ &= \frac{1}{2}\mu C_{ox}\frac{W}{L}(Vref - Vdata)^2 \end{aligned}$$

In Equation 1, μ denotes the mobility of the first transistor M1, $C_{ox}$ denotes gate capacitance per unit area of the first transistor M1, W/L denotes a ratio of width to length of the channel of the first transistor M1, and Vdata denotes the voltage of the data signal DS.

Referring to Equation 1, the current supplied from the first transistor M1 to the OLED is determined by a difference between the voltage of the reference power source Vref and the voltage of the data signal DS. That is, the pixel according to embodiments of the present invention can display a desired luminance of image regardless of the threshold voltage variation of the first transistor M1 and the IR drop of the first power source ELVDD.

Figure 5:
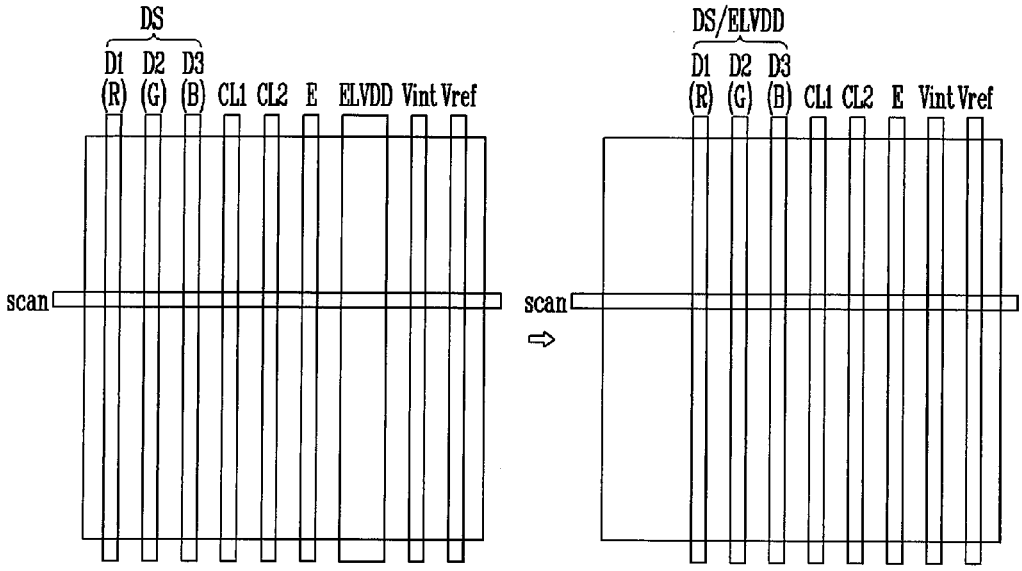
FIG. 5 is a schematic view showing signal lines for the pixel of FIG. 3.

According to embodiments of the present invention, the first power source ELVDD and the data signal DS are provided by the data lines D1 to Dm. In this case, as shown in FIG. 5, an additional signal line for supplying the first power source ELVDD is omitted, thus increasing an opening ratio. Further, When the signal line for supplying the first power source ELVDD is omitted, an additional space is secured, thus enabling the layout of the pixel even at a high resolution. Furthermore, the parasitic capacitor is minimized or reduced by the signal line, thus minimizing or reducing a problem caused by an RC delay.

Figure 6:
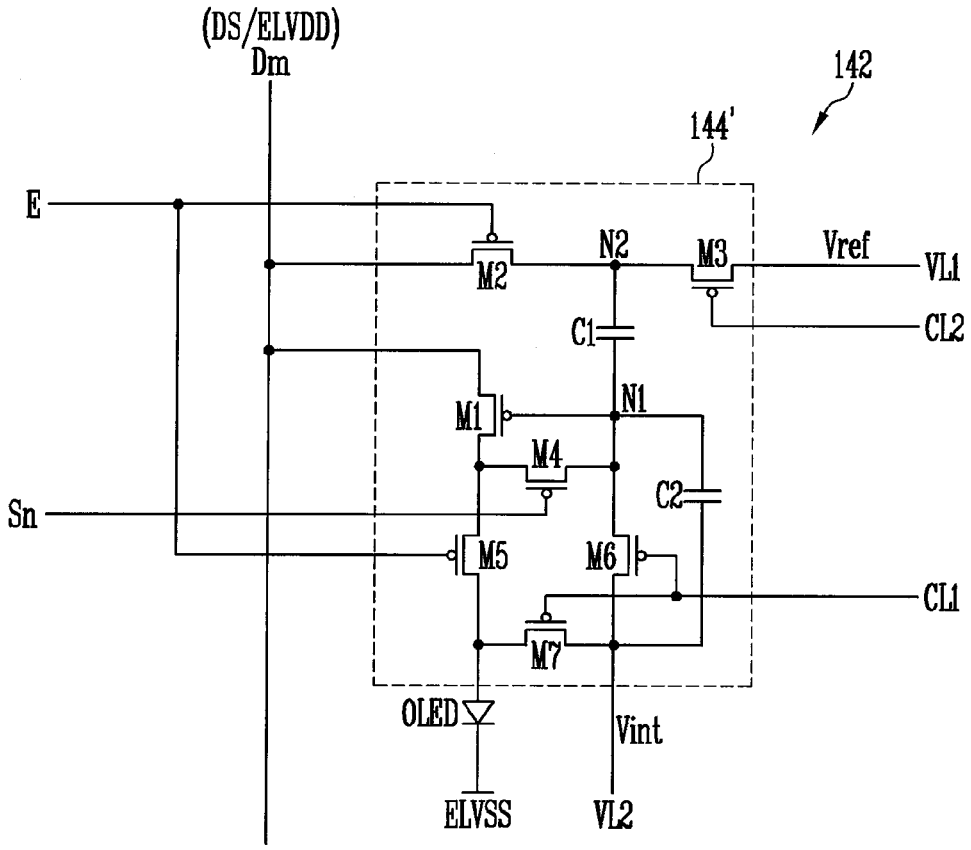
FIG. 6 is a view showing a pixel according to a second embodiment of the present invention.

FIG. 6 is a view showing a pixel according to a second embodiment of the present invention. Elements common to FIGS. 3 and 6 will carry the same reference numerals, and a detailed description of the common elements will be omitted herein.

Referring to FIG. 6, a pixel 142 according to the second embodiment of the present invention includes an OLED, and a pixel circuit 144' configured to control a current supplied to the OLED.

The pixel circuit 144' further includes a second capacitor C2 connected between a first node N1 and a second power line VL2. The second capacitor C2 stores the voltage of the first node N1. That is, the second embodiment of the present invention further includes the second capacitor C2, thus stably maintaining the voltage of the first node N1.

Figure 7:
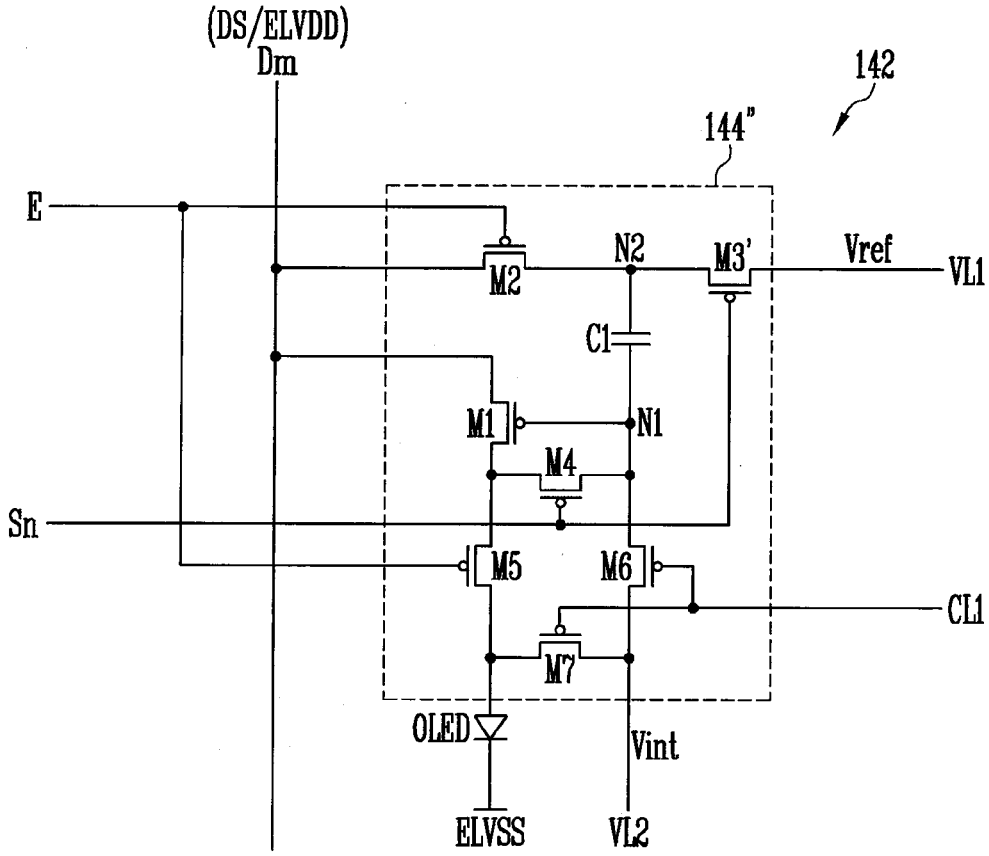
FIG. 7 is a view showing a pixel according to a third embodiment of the present invention.

FIG. 7 is a view showing a pixel according to a third embodiment of the present invention. Elements common to FIGS. 3 and 7 will carry the same reference numerals, and a detailed description of the common elements will be omitted herein.

Referring to FIG. 7, a pixel 142 according to the third embodiment of the present invention includes an OLED, and a pixel circuit 144" configured to control a current supplied to the OLED.

A third transistor M3' included in the pixel circuit 144" is connected between a first power line VL1 and a second node N2. Further, a gate electrode of the third transistor M3' is connected to a scan line Sn. The third transistor M3' is turned on when a scan signal is provided to the scan line Sn, thus supplying the voltage of a reference power source Vref to the second node N2.

To be more specific, when the scan signal is provided to the scan line Sn, the third transistor M3' and the fourth transistor M4 are turned on. When the fourth transistor M4 is turned on, the voltage of the data signal DS from the data line Dm is supplied to the first node N1. When the third transistor M3 is turned on, the voltage of the reference power source Vref is supplied to the second node N2. The first capacitor C1 charges a voltage corresponding to a difference between the first node N1 and the second node N2.

In the third embodiment of the present invention, the third transistor M3' is turned on only when the voltage of the data signal DS is charged, and is turned off in other cases. Even when the third transistor M3' is turned off, the first capacitor C1 maintains the voltage of the reference power source Vref at the second node N2.

Figure 8:
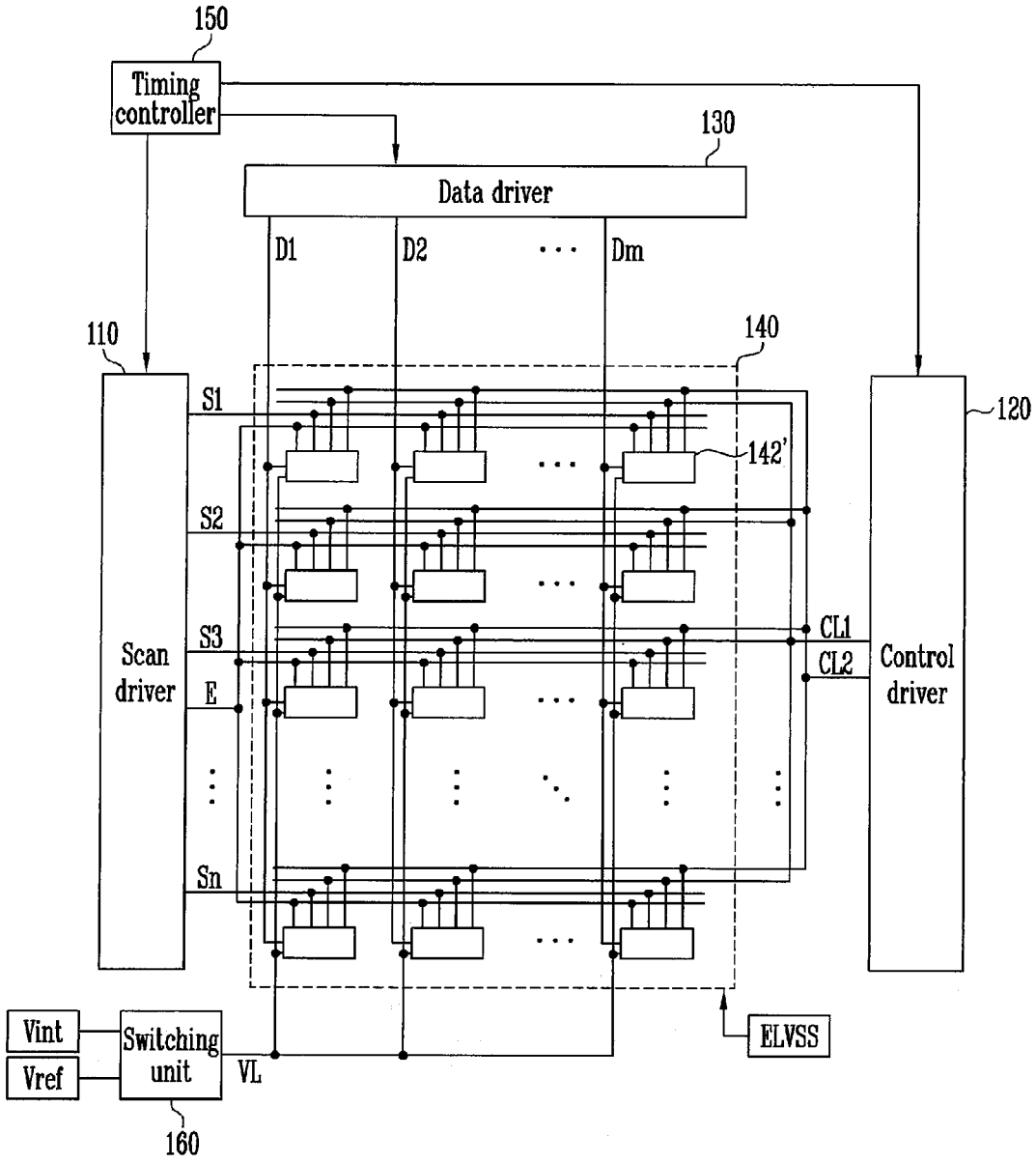
FIG. 8 is a view showing an organic light emitting display device according to a second embodiment of the present invention.

FIG. 8 is a view showing an organic light emitting display device according to a second embodiment of the present invention. Elements common to FIGS. 1 and 8 will carry the same reference numerals, and a detailed description of the common elements will be omitted herein.

Referring to FIG. 8, the organic light emitting display device according to the second embodiment of the present invention includes a power line VL connected in common with pixels 142', and a switching unit 160 (e.g., a switch 160) connected with the power line VL.

Figure 10:
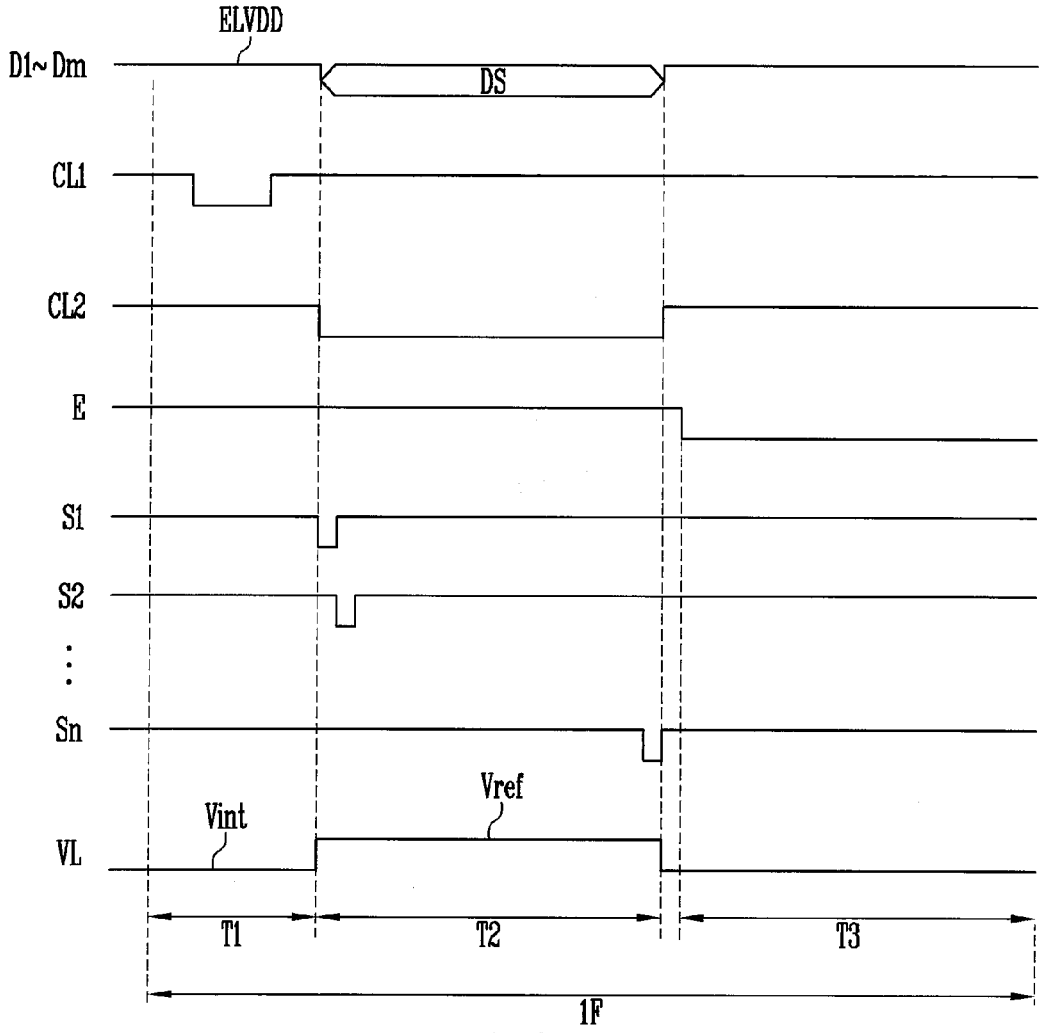
FIG. 10 is a waveform diagram showing a driving method according to a second embodiment of the present invention.

The switching unit 160 is connected to the initial power source Vint and the reference power source Vref. As shown in FIG. 10, the switching unit 160 supplies the voltage of the initial power source Vint to the power line VL during the first and third periods T1 and T3 of one frame 1 F, and supplies the voltage of the reference power source Vref during the second period T2.

Figure 9:
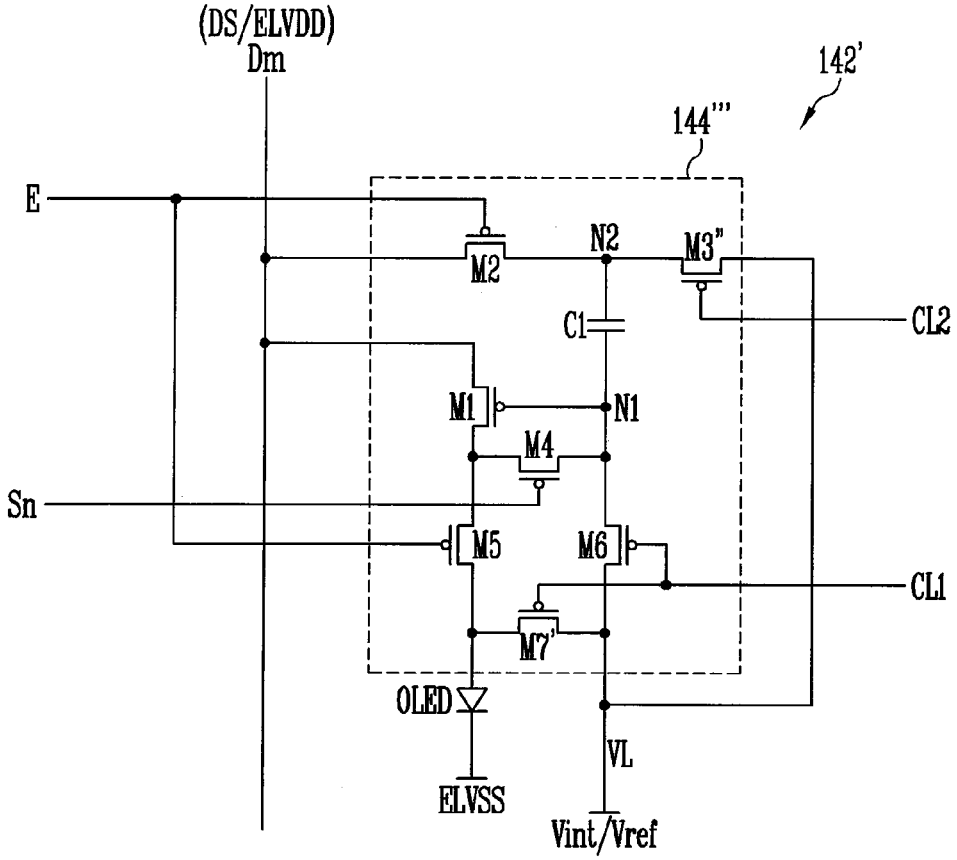
FIG. 9 is a view showing a pixel according to a fourth embodiment of the present invention.

FIG. 9 is a view showing a pixel according to a fourth embodiment of the present invention. Elements common to FIGS. 3 and 9 will carry the same reference numerals, and a detailed description of the common elements will be omitted herein.

Referring to FIG. 9, a pixel 142' according to the fourth embodiment of the present invention includes an OLED, and a pixel circuit 144''' configured to control a current supplied to the OLED.

The pixel circuit 144''' is provided with first to seventh transistors M1 to MT.

The third transistor M3'' is connected between the second node N2 and the power line VL, and is turned on when the second control signal is provided to the second control line CL2. As shown in FIG. 10, the second control signal is provided during the second period T2 of one frame 1 F, so that the third transistor M3'' connects the power line VL to the second node N2 during the second period T2 of one frame 1 F.

The power line VL is connected to the second node N2, and the voltage of the reference power source Vref supplied to the power line VL during the second period T2 is supplied to the second node N2. Thus, the first capacitor C1 may stably store a voltage corresponding to a difference between the reference power source Vref and the data signal DS during the second period T2.

The seventh transistor M7' is connected between the anode electrode of the OLED and the power line VL, and is turned on when the first control signal is provided to the first control line CL1. The first control signal is provided during the first period T1 of one frame 1 F, so that the seventh transistor M7' connects the power line VL to the anode electrode of the OLED during the first period T1 of one frame 1 F.

The power line VL is connected to the anode electrode of the OLED, and the voltage of the initial power source Vint supplied to the power line VL during the first period T1 is supplied to the anode electrode of the OLED. Thus, during the first period T1, the anode electrode of the OLED is initialized to the voltage of the initial power source Vint. In addition, since the sixth transistor M6 is turned on in response to the first control signal, the first node N1 is also initialized to the voltage of the initial power source Vint during the first period T1.

Since the remaining configuration and driving method are the same as or substantially the same as the pixel and the driving method thereof according to the first embodiment of the present invention, a detailed description will be omitted herein.

For the convenience of description, the transistors are illustrated as PMOS in the above description, but the present invention is not limited thereto. In other words, the transistors may be formed as NMOS.

Further, according to embodiments of the present invention, the OLED may generate red, green, blue or white light depending on a current. When the OLED generates the white light, it is possible to implement a color image using a separate color filter.

By way of summation and review, an organic light emitting display device includes a plurality of pixels that are arranged in a matrix form at the intersections of the data lines, the scan lines, and the power lines. The pixels generally include an OLED, two or more transistors including the driving transistor, and one or more capacitors.

The organic light emitting display device has low power consumption, but a current flowing to the OLED may be changed according to the threshold-voltage variation of the driving transistor included in each of the pixels, thus causing a non-uniform display. That is, the characteristics of the driving transistor provided in each of the pixels are changed according to the manufacturing-process parameter. In practice, it is very difficult or even impossible to manufacture the organic light emitting display device such that all the transistors of the organic light emitting display device have the same or substantially the same characteristics. Hence a threshold-voltage variation of the driving transistor inevitably results.

There has been proposed a method of adding a compensation circuit having a plurality of transistors and capacitors to each of the pixels. The compensation circuit included in each of the pixels charges a voltage corresponding to the threshold voltage of the driving transistor during one horizontal period, thus compensating for the variation of the driving transistor.

The compensation circuit formed on each of the pixels is additionally connected to a plurality of signal lines. That is, the plurality of signal lines is additionally formed on a panel to allow the compensation circuit to be driven as desired. When the plurality of signal lines is additionally formed on the panel as such, an opening ratio is reduced. Particularly in the high resolution where the size of the pixel becomes small, the layout itself may be very difficult or even impossible. Further, the pixels may not be charged with the voltage of a desired data signal due to the parasitic capacitor (i.e., RC delay) caused by the signal lines.

The pixel and the organic light emitting display device using the pixel according to the embodiment of the present invention are configured to provide the first power source and the data signal to the data line, thus minimizing or reducing the number of signal lines. When the number of the signal lines is minimized or reduced, additional space is secured, thus ensuring a degree of freedom upon designing the pixel at the high resolution. Further, When the number of the signal lines is minimized or reduced, the parasitic capacitor caused by the signal lines is minimized or reduced, and thereby a problem resulting from the RC delay can be minimized or reduced.

Further, the pixel and the organic light emitting display device using the pixel according to the embodiment of the present invention allow a desired image luminance to be displayed regardless of the threshold voltage of the driving transistor and the IR drop of the first power source.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims, and their equivalents.

What is claimed is:

1. A pixel, comprising:

an organic light emitting diode (OLED);

a first transistor comprising a first electrode coupled a data line and a second electrode coupled an anode electrode of the OLED, and configured to control a current supplied to the OLED based on a voltage applied to a first node;

a second transistor coupled between the data line and a second node;

a third transistor coupled between the second node and a first power line for supplying reference power; and a first capacitor coupled between the first node and the second node.

2. The pixel as claimed in claim 1, further comprising:

a fourth transistor coupled between the second electrode of the first transistor and the first node;

a fifth transistor coupled between the second electrode of the first transistor and the anode electrode of the OLED; and a sixth transistor coupled between the first node and a second power line for supplying initial power.

3. The pixel as claimed in claim 2, wherein the reference power is set to a specific voltage that is within a voltage range of a data signal provided to the data line, and wherein the initial power is set to a voltage that is lower than a voltage of the data signal.

4. The pixel as claimed in claim 2, wherein turn-on periods of the second transistor, the third transistor, and the sixth transistor do not overlap each other.

5. The pixel as claimed in claim 4, wherein the fifth transistor is configured to be turned on and turned off simultaneously with the second transistor.

6. The pixel as claimed in claim 4, wherein a turn-on period of the fourth transistor overlaps the turn-on period of the third transistor.

7. The pixel as claimed in claim 2, further comprising:

a seventh transistor coupled between the anode electrode of the OLED and the second power line, the seventh transistor being configured to be turned on and off simultaneously with the sixth transistor.

8. The pixel as claimed in claim 2, further comprising:

a second capacitor coupled between the first node and the second power line.

9. The pixel as claimed in claim 2, wherein the first power line and the second power line are set as one power line, wherein the reference power is supplied to the power line during a preset period of one frame, and wherein the initial power is supplied to the power line during a remaining period thereof.

10. The pixel as claimed in claim 1, wherein the voltage of a data signal is supplied to the data line during a period when the third transistor is configured to be turned on, and a voltage of a first power source that is higher than the voltage of the data signal is supplied to the data line during a remaining period.

11. An organic light emitting display device, comprising:

pixels positioned in regions defined by scan lines, data lines, a light-emission control line, a first control line, and a first power line;

a scan driver configured to provide a light-emission control signal to the light-emission control line during first and second periods of one frame period and to sequentially provide scan signals to the scan lines during the second period;

a data driver configured to provide data signals to the data lines during the second period, and to supply a voltage of a first power source that is set to be higher than a voltage of the data signals to the data lines during a third period subsequent to the first and second periods; and a control driver configured to provide a first control signal to the first control line during the first period.

12. The organic light emitting display device as claimed in claim 11, wherein the data driver comprises:

a signal generator configured to generate the data signal;

buffers formed on respective channels of the signal generator; and selectors coupled, respectively, to the data lines, and coupling the data lines to the first power source or the buffers, wherein the selectors couple the data lines to the first power source during the first period and the third period, and couple the data lines to the buffers during the second period.

13. The organic light emitting display device as claimed in claim 11, wherein among the pixels, a pixel positioned at an $i^{th}$ (i is a natural number) horizontal line and a $j^{th}$ (j is a natural number) vertical line comprises:

an OLED;

a first transistor comprising a first electrode coupled to a $j^{th}$ data line and a second electrode coupled to an anode electrode of the OLED, the first transistor being configured to control a current supplied to the OLED based on a voltage applied to a first node;

a second transistor coupled between the $j^{th}$ data line and a second node, the second transistor being configured to be turned off when the light-emission control signal is provided and being configured to be turned on in other cases;

a third transistor coupled between the second node and the first power line; and a fourth transistor coupled between the second electrode of the first transistor and the first node, and configured to be turned on when a scan signal is provided to an $i^{th}$ scan line.

14. The organic light emitting display device as claimed in claim 13, further comprising:

a second control line coupled to the pixels, and receiving a second control signal from the control driver during the second period, wherein the third transistor is configured to be turned on when the second control signal is provided.

15. The organic light emitting display device as claimed in claim 13, wherein the third transistor is configured to be turned on when the scan signal is provided to the $i^{th}$ scan line.

16. The organic light emitting display device as claimed in claim 13, wherein the first power line is supplied with a voltage of a reference power source that is set to a voltage which is within a voltage range of the data signal.

17. The organic light emitting display device as claimed in claim 13, further comprising:

a second power line coupled to the pixels, and configured to supply a voltage of an initial power source that is set to a voltage that is lower than the voltage of the data signal.

18. The organic light emitting display device as claimed in claim 17, wherein among the pixels, the pixel positioned at the $i^{th}$ horizontal line and the $j^{th}$ vertical line comprises:

a fifth transistor coupled between the second electrode of the first transistor and the anode electrode of the OLED, the fifth transistor being configured to be turned off when the light-emission control signal is provided and being configured to be turned on in other cases;

a sixth transistor coupled between the second power line and the first node, and configured to be turned on when the first control signal is provided; and a seventh transistor coupled between the anode electrode of the OLED and the second power line, and configured to be turned on when the first control signal is provided.

19. The organic light emitting display device as claimed in claim 13, further comprising:

a switch configured to supply the voltage of an initial power source, which is set to be lower than the voltage of the data signal, to the first power line during the first period and the third period, and to supply the voltage of a reference power source, which is set to a voltage within a range of the data signal, to the first power line during the second period.

20. The organic light emitting display device as claimed in claim 19, wherein among the pixels, the pixel positioned at the $i^{th}$ horizontal line and the $j^{th}$ vertical line comprises:

a fifth transistor coupled between the second electrode of the first transistor and the anode electrode of the OLED, the fifth transistor being configured to be turned off when the light-emission control signal is provided and being configured to be turned on in other cases;

a sixth transistor coupled between the first power line and the first node, and configured to be turned on when the first control signal is provided; and a seventh transistor coupled between the anode electrode of the OLED and the first power line, and configured to be turned on when the first control signal is provided.

* * * * *